US005253601A

United States Patent [19]

Sanvito

[11] Patent Number: 5,253,601

[45] Date of Patent: Oct. 19, 1993

[54] DETACHABLE TOP FEED UNIT FOR SEWING MACHINES

[75] Inventor: Roberto Sanvito, Buccinasco, Italy

[73] Assignee: Rimoldi, S.r.l., Milan, Italy

[21] Appl. No.: 4,432

[22] Filed: Jan. 14, 1993

[30] Foreign Application Priority Data

Feb. 28, 1992 [IT] Italy ..... MI92U000177

[51] Int. Cl.[5] ..... D05B 27/04; D05B 73/02

[52] U.S. Cl. ..... 112/320; 112/168; 112/259

[58] Field of Search ..... 112/320, 311, 303, 168, 112/258, 259, 260, 321

[56] References Cited

U.S. PATENT DOCUMENTS 4,422,398 12/1983 Dusch ..... 112/320
4,590,875 5/1986 Sanrito et al. ..... 112/168
4,996,934 3/1991 Lue ..... 112/259 X
5,113,773 5/1992 Klundt ..... 112/320

*Primary Examiner*—Clifford D. Crowder
*Assistant Examiner*—Paul C. Lewis
*Attorney, Agent, or Firm*—Laff, Whitesel, Conte & Saret

[57] ABSTRACT

A top feed unit comprises a vertical-movement kinematic mechanism (19) and a horizontal-movement kinematic mechanism (20) acting on a rocking arm (18) supporting a top feed dog (17) and operated by respective eccentrics (21, 29) fitted to an auxiliary shaft (37). The vertical- and horizontal-movement kinematic mechanisms (29, 20) and the auxiliary shaft (37) are contained in a housing structure (34) which can be detachably engaged to the sewing machine head (7). The auxiliary shaft (37) is connected to an interconnecting stem (41) rotatably connected to the sewing machine arm (6) and driven in rotation, through a toothed belt (46), by the upper drive shaft (8) of the sewing machine (2).

6 Claims, 3 Drawing Sheets

IV 34
2
7
25
24
35b
32
20
13
19
26
33
18
28
1
27
18
27a
IV
13

DETACHABLE TOP FEED UNIT FOR SEWING MACHINES

BACKGROUND OF THE INVENTION

1. Field of the Invention

The present invention relates to a detachable top feed unit for sewing machines, for the type comprising: at least one top feed dog operatively connected to a rocking arm; a first control eccentric and a second control eccentric receiving a rotatory motion from an upper drive shaft, longitudinally housed in an arm of a sewing machine; a vertical-movement kinematic mechanism operatively interposed between the first eccentric and the rocking arm for transmitting a vertical reciprocating motion to the top feed dog; a horizontal-movement kinematic mechanism operatively interposed between the second eccentric and the rocking arm for transmitting a horizontal reciprocating motion to the top feed dog.

2. Prior Art

It is known that in sewing machines feed-advance movement of a workpiece while a sewing is being carried out usually relies on bottom feed dogs reciprocated across a so-called "needle plate" located flush with a cloth plate or work supporting surface along which the workpiece runs.

In order to be sure that the bottom feed dogs may act correctly on the workpiece for feeding purposes, a presser foot is provided that, supported by a presser bar, exerts a localized biasing spring action on the feed dogs.

The foregoing being stated, it is pointed out that under given situations it is convenient that the action of a top feed unit should be combined with the action exerted by the bottom feed dogs, which top feed unit is provided with reciprocating feed dogs acting upon the workpiece, at the presser foot too.

For example, the presence of the top feed unit is provided to be appropriate when the workpiece is made of a material offering a low smoothness degree under the presser foot.

As a further example, the top feed unit is adapted for use when two superposed fabrics must advance at different speeds while a sewing is being carried out for achieving particular puckering effects or others.

Presently, the top feed unit is integrally housed in a head which, as known, overhangs the work supporting surface and is part of the sewing machine.

The top feed unit substantially comprises a vertical-movement kinematic mechanism and a horizontal-movement kinematic mechanism both operated by respective eccentrics fitted to an upper drive shaft housed in the upper portion of the sewing machine and driven in rotation, as known, for causing operation, among other things, of a needle bar slidably guided through the head.

In greater detail, each of said kinematic mechanisms comprises a connecting rod operatively connected to the respective eccentric for transmitting, as a result of the rotation of said eccentric, an oscillating movement involving angular rotation to a corresponding intermediate shaft.

By suitable linkages, the oscillating movement of each intermediate shaft is converted to a horizontal or vertical reciprocating motion of a rocking arm to which the top feed dog is fastened. The combination of the vertical and horizontal reciprocating motions respectively transmitted by the above described kinematic mechanisms causes the top feed dog to move according to a substantially elliptical trajectory and suitably interfere with the workpiece for giving rise to the desired feed-advance of same.

After the above description it will be recognized that at the present time the presence of the top feed unit intails many restrictions in terms of flexibility of use of the sewing machine, referring in particular to the great number of situations in which the machine is to be used for carrying out workings in which the top feed unit is unnecessary or is even unacceptable.

In fact, being most of the components of the feed unit directly mounted within the machine head, the only solution to which an operator can resort for making the sewing machine adapted to the above workings in which the presence of said top feed unit is unacceptable consists in removing the feed dog from the corresponding rocking arm.

However, this expedient does not lead to satisfactory results in that the rocking arm reciprocating at the sewing area represents at all events an obstacle against the execution of certain particular workings, also because, in order to avoid risks of accidents, it is often placed within appropriate safety guards which are rather bulky.

In addition and above all, frictions and forces of inertia generated by the great number of components forming the top feed unit impair the operation speed of the sewing machine to a great extent, that is in the order of 30%.

In conclusion, due to the above restrictions the use of a sewing machine provided with the top feed unit appears to be inconvenient, above all with reference to industrial workings, when workings are to be carried out in which the presence of this feed unit is unnecessary. As a result, at the present time all workings for which the top feed unit is not required are executed on different sewing machines. Therefore in many cases sewing machines provided with said top feed unit are subjected to long periods of inactivity.

It is also to be pointed out that, at the present state of the art, the installation of the feed unit always involves the presence of a great number of actuating members in a very reduced space, that is the space available within the sewing machine head.

This situation is further made worse by the fact that the head must also necessarily contain other different members and/or kinematic mechanisms, such as for example the needle bar and the crank mechanism for its operation, the presser bar, and still other members.

Due to the above problems relating to bulkiness, it is always necessary to study and set up very complicated kinematic mechanisms involving high production costs and the installation of which is not convenient.

In addition said kinematic mechanisms just as a result of their complicated structure, are of uncertain reliability and involve many problems when servicing is needed. In the connection it is to be taken into due consideration the fact that any repair of even normal servicing operations to be carried out on the top feed unit inevitably bring about long periods of inactivity of the sewing machine.

SUMMARY OF THE INVENTION

The main object of the present invention is substantially to solve the problems of the known art, by providing an advantageous technical solution enabling the top feed unit to be mounted to and dismantled from any sewing machine suitably arranged for connection of such a device, in a very convenient manner.

The foregoing and further objects that will become more apparent in the course of the following description are substantially attained by a detachable top feed unit for sewing machines, comprising: a box-shaped housing structure operatively receiving the vertical- and horizontal-movement kinematic mechanisms; detachable coupling means for removably engaging the box-shaped housing structure to the sewing machine; an auxiliary shaft rotatably received in the housing structure, carrying said first and second control eccentrics and provided at one end thereof with a first half-coupling appearing externally of the box-shaped structure through an access opening; an interconnecting stem rotatably engaged to the sewing machine and carrying, at one end thereof, a second half-coupling to be operatively engaged with said first half-coupling when the housing structure is connected to the sewing machine; driving-gear means operating between said upper drive shaft and the interconnecting stem for transmitting the rotatory motion from the upper drive shaft to the auxiliary shaft.

BRIEF DESCRIPTION OF THE DRAWINGS

Further features and advantages will be best understood from the detailed description of a preferred embodiment of a detachable top feed unit for sewing machines in accordance with the present invention, given hereinafter by way of non-limiting example with reference to the accompanying drawings, in which.

DESCRIPTION OF THE PREFERRED EMBODIMENT

Figure 1:
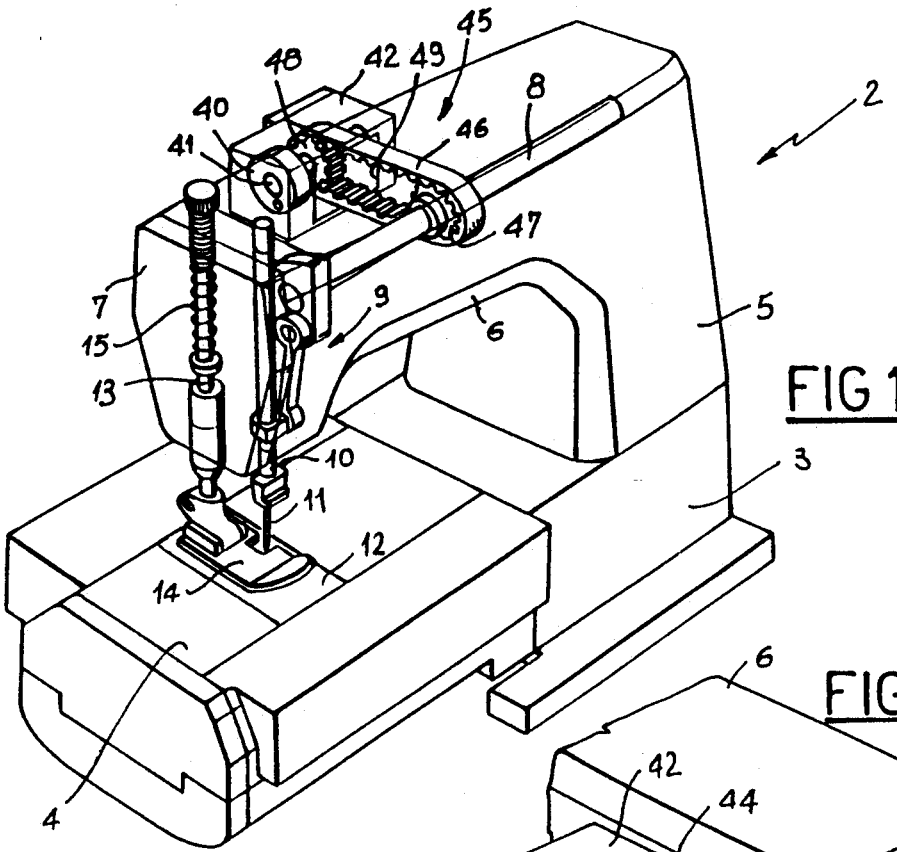
FIG. 1 is a perspective view diagrammatically showing in phantom a sewing machine arranged to receive a top feed unit in engagement, in accordance with the invention.

Referring to the drawings, a detachable top feed unit for sewing machines in accordance with the present invention has been generally identified by reference numeral 1.

The feed unit 1 is adapted to be associated with a sewing machine 2 that, in a manner known per se, essentially comprises a bed 3 on which a substantially horizontal cloth plate 4 is defined. Standing from the bed 3 is a standard 5 from the upper part of which an arm 6 horizontally extends, which arm supports a head 7 in cantilevered fashion over the cloth table 4.

Figure 3:
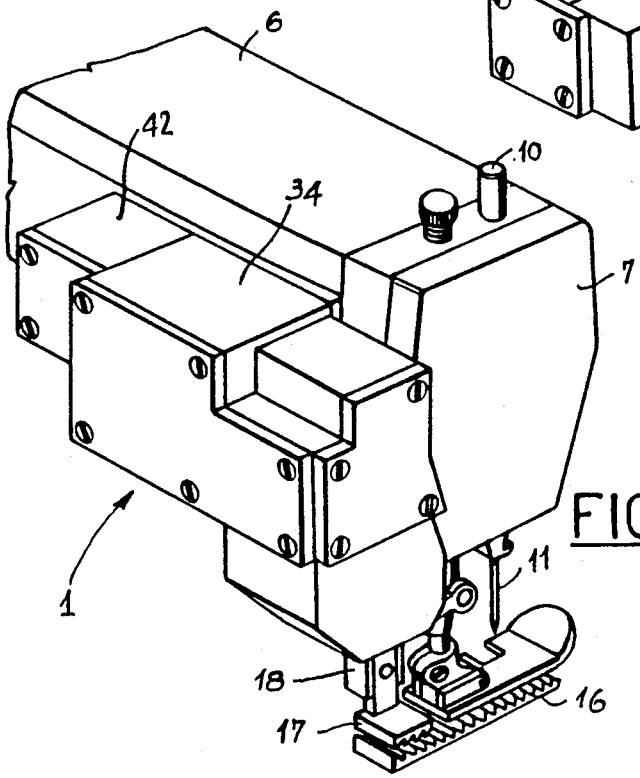
FIG. 3 is a perspective view similar to FIG. 2 showing the top feed unit mounted to the sewing machine.

An upper drive shaft 8 extends along the inner part of the arm 6 and is conventionally driven in rotation for transmitting a substantially vertical reciprocating motion, through a kinematic connecting rod-crank mechanism 9, to a needle bar 10 slidably guided in the head 7 and carrying one or more needles 11 at the lower part thereof. The needles 11 pass through the workpiece (not shown) at the so-called needle plate 12, so as to cooperate with other sewing instrumentalities (not shown as known per se) housed in the machine bed 3 for the execution of a seam, As shown in FIG. 1, also housed in the head 7 is a presser bar 13 carrying a presser foot 14 at the lower part thereof. By effect of a spring 15 or equivalent spring means, the presser foot 14 exerts an appropriate pressure on the workpiece, at an area located above bottom feed dogs 16 (FIG. 3) conventionally operating across the needle plate 12 for making the workpiece advance while a stitching is being executed.

The foregoing being stated, the feed unit 1 is arranged to cooperate with said bottom feed dogs 16 by at least one corresponding top feed dog 17, designed to act on the workpiece, in the vicinity of the presser foot. Depending on requirements, the top feed dog 17 will be able to be indiscriminately positioned behind, before or beside the needle 11.

In a manner known per se, the top feed dog 17 is fastened to a rocking arm 18 which is submitted to the simultaneous action of a vertical-movement kinematic mechanism 19 and a horizontal-movement kinematic mechanism 20, adapted to operate the rocking arm according to reciprocating movements in the vertical and horizontal directions respectively. The combination of the vertical reciprocating motion with the horizontal reciprocating motion is such that it causes the top feed dog 17 to perform a substantially elliptical trajectory, elongated in the horizontal direction, thereby suitably interferring with the workpiece for feed-advance purposes.

In greater detail, the vertical-movement kinematic mechanism 19 essentially comprises one eccentric 21 engaging a first driving connecting rod 22 acting on a first fork-shaped arm 23 fastened to a first intermediate stem 24. Consequently, by effect of a rotation imparted to the first eccentric 21, as better clarified in the following, the first intermediate stem 24 is subjected o a reciprocating angular oscillation movement about its own axis. This reciprocating angular oscillation movement is converted to said reciprocating motion of the rocking arm 18, via an intermediate arm 25 fastened to the first intermediate stem 24 and acting, through an interconnecting lever 26, on a lifting lever 27 connected to the rocking arm by a link 28 and pivotally mounted to an attachment collar **27*a* removably fitted on the presser bar 13** and fastened thereto.

The horizontal-movement kinematic mechanism 20 in turn comprises a second eccentric 29 engaged to a second connecting rod 30 acting on a second fork-shaped arm 31 fastened to a second intermediate stem 32. In the same manner as said with reference to the first intermediate stem 24, the second intermediate stem 32 is also subjected to a reciprocating angular oscillation movement following driving in rotation of the second eccentric 29. This angular oscillation movement is converted to the desired horizontal reciprocating motion by a second intermediate arm 33 directly connected to the rocking arm 18 carrying the top feed dog 17.

It will be noted that the vertical- and horizontal-movement kinematic mechanisms, 19 and 20, known per se and conventional, have been described in short by way of indication only, and will be able to have different embodiments depending on requirements.

As can be easily viewed from the accompanying drawings, the vertical- and horizontal-movement kinematic mechanisms 19 and 20 are operatively received within the box-shaped housing structure 24 adapted to be removably engaged behind the head 7 of the sewing machine 2. The engagement of the housing structure 34 to the sewing machine 2 takes place through coupling means essentially comprising at least a first abutment surface 35*a* and a second abutment surface 35*b*, formed in the sewing machine and the box-shaped structure respectively. Such abutment surfaces 35*a*, 35*b* can be brought into abutment relation with each other for enabling the subsequent fastening of the housing structure 34, and so the whole top feed unit 1, to the sewing machine 2 by means of screw threaded elements 36 operatively engaging in corresponding threaded holes 36*a* provided in the sewing machine.

For operation of the vertical- and horizontal-movement kinematic mechanisms 19 and 20 the top feed unit 1 of the invention further comprises an auxiliary shaft 37 rotatably engaged in the housing structure 34, extending parallelly to the upper drive shaft 8 and carrying the first and second eccentrics 21, 29.

The auxiliary shaft 37 further carries one half-coupling 38 at one end thereof, said half-coupling appearing externally of the box-shaped housing structure 34 through an access opening 39 formed on purpose on one side thereof.

On mounting of the top feed unit 1 to the sewing machine 2, the first half-coupling 38 is operatively connected to a second half-coupling 40 carried at the end of an interconnecting stem 41 rotatably engaged to the sewing machine 2.

Figure 4:
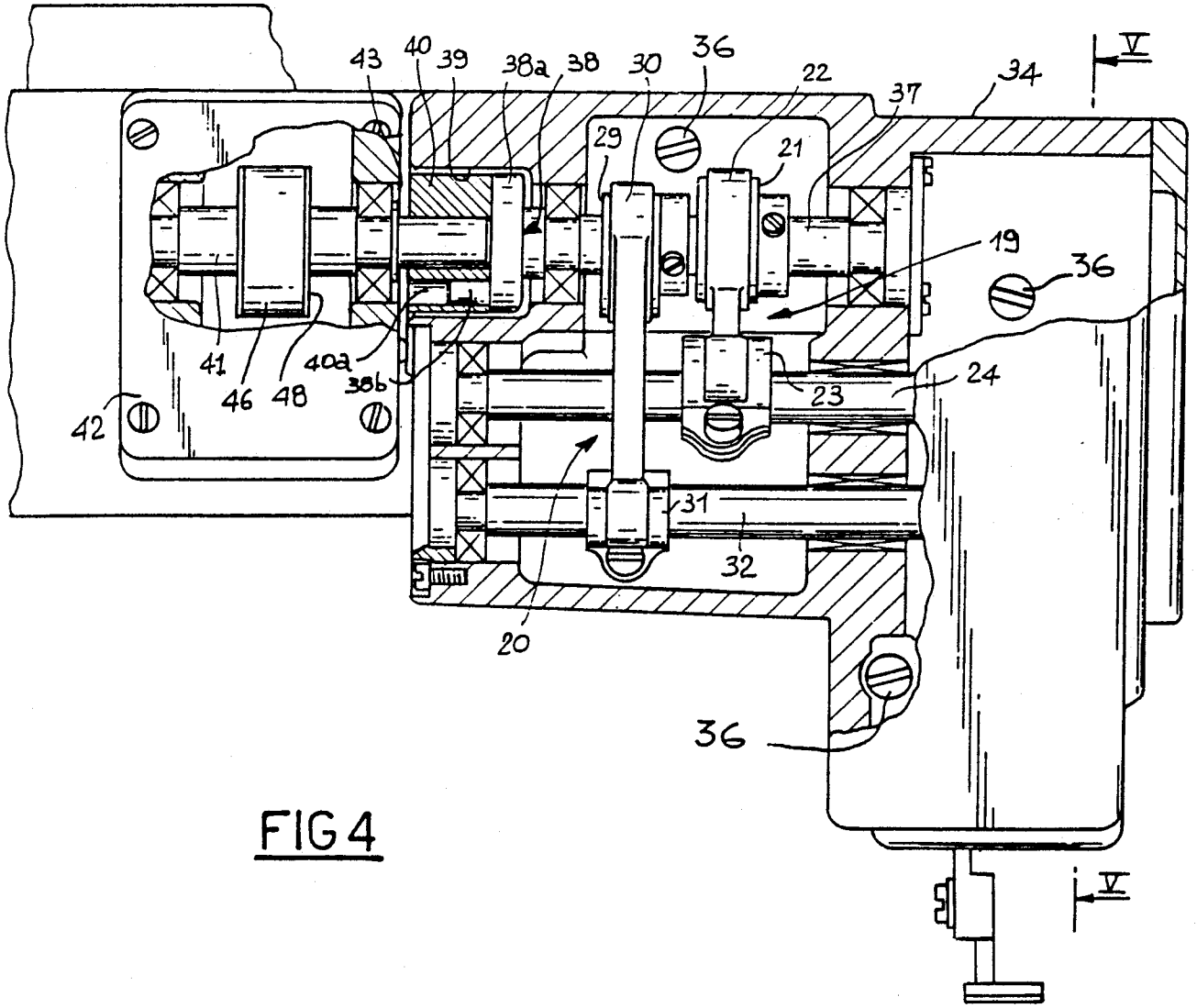
FIG. 4 shows the feed unit mounted to the sewing machine and sectioned along line IV—IV in FIG. 5.
Figure 5:
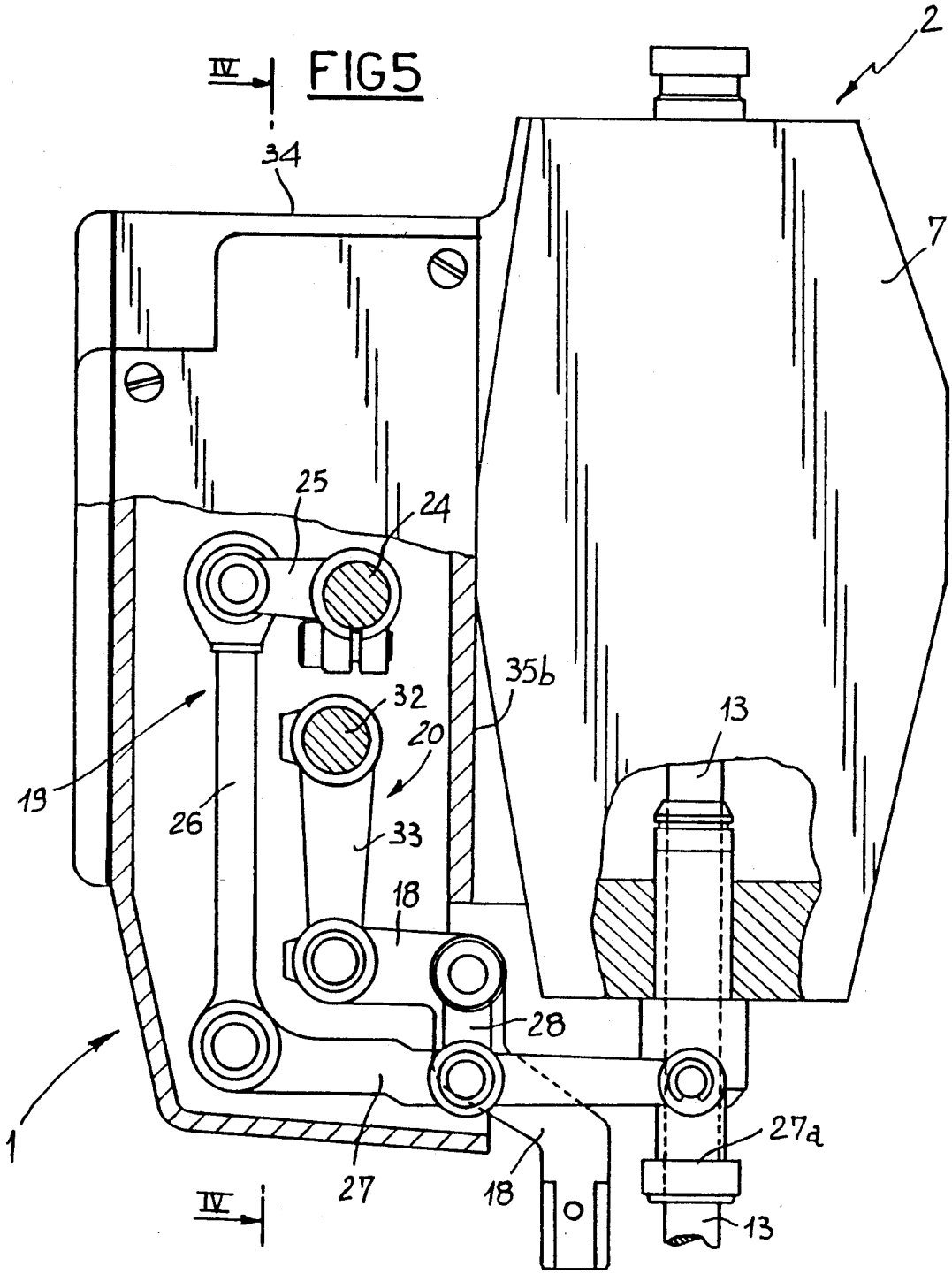
FIG. 5 is a sectional view of the feed unit taken along line V—V in FIG. 4.

In greater detail, as can be seen in FIG. 4, the first half-coupling 38 essentially comprises a disk-shaped flange 38*a* fitted to the auxiliary shaft 37 and carrying at least one pin 38*b* in a misaligned position, which pin engages in a mating seating 40*a* arranged in the second half-coupling 40. Therefore, matching between the first and second half-couplings 38, 40 can take place only according to a predetermined mutual angular positioning, so that, on mounting of the top feed unit 1, the vertical- and horizontal-movement kinematic mechanisms 19 and 20 are already phased with the other machine members for the purpose of achieving a synchronized actuation of the top feed dog 17.

Figure 2:
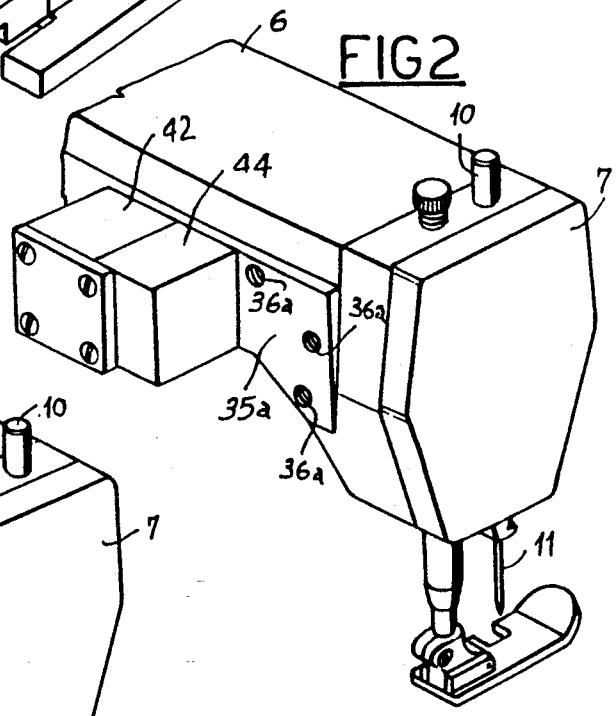
FIG. 2 is a perspective view showing a detail of the sewing machine arm viewed from the opposite side with respect to FIG. 1.

The interconnecting stem 41 is operatively housed, preferably according to an axis parallel to the upper drive shaft 8, in a casing 42 fastened to the external part of the arm 6 and exhibiting a side opening 43 through which the second half-coupling 40 projects. As shown in FIG. 2, in the absence of the top feed unit 1 the second half-coupling 40 can be optionally enclosed by a protection cover 44 removably engaged to the casing 42.

Still in accordance with the present invention, the interconnecting stem 41 is connected to the upper drive shaft 8 by driving-gear means 45 that, when the top feed unit 1 is mounted to the sewing machine 2, transmits the rotatory movement from the upper drive shaft 8 to the auxiliary shaft 37. In the embodiment described, said driving-gear means 45 comprises a toothed belt 46 operatively engaged between a driving pulley 47 fitted to the upper drive shaft 8 and a driven pulley 48 preferably of same diameter, fitted to the interconnecting stem 41.

The toothed belt 46 extends through an auxiliary opening 49 formed on the rear part of the sewing machine arm 6, to which opening the casing 42 housing the interconnecting stem 41 is fastened.

The present invention attains the intended purposes and achieves important advantages, in particular in terms of flexibility of use of the sewing machines.

In fact, the top feed unit can be easily mounted to the sewing machine in case of need, and easily removed therefrom when its presence appears to be unnecessary.

Consequently, not only the sewing machine is adapted for use when workings requiring the presence of the top feed unit are to be executed, but it can also be utilized without offering reduced performance when the presence of the top feed unit is unnecessary. In fact, the removal of the top feed unit brings about the removal of all related kinematic mechanism that in known sewing machines provided with the top feed unit greatly impair the operating speed of the machine and also create great trouble as far the practical use of the machine is concerned.

It will be also noted that on adapting the removable feed unit of the invention, only few and simple modifications are required for the arrangement of the sewing machine, and that the incidence of such modifications on the machine production costs is practically negligible. Said modifications in fact only involve provision of the interconnecting stem and connection of same to the upper drive shaft by means of the toothed belt.

It will be also recognized that, being the top feed unit located to the outside of the sewing machine head, the available space within the head can be advantageously utilized for housing other accessory devices adapted to the execution of particular workings.

Many modifications and variations may be made to the invention as conceived, all of them falling within the scope of the inventive idea characterizing it.

In particular, it will be noted that, while described and shown in combination with a flat base sewing machine, the invention can be adopted on any type of sewing machine.

What is claimed is:

1. A detachable top-feed unit for sewing machines, comprising:

at least one top feed dog (17) operatively connected to a rocking arm (18);

a first control eccentric (21) and a second control eccentric (29) receiving a rotatory motion from an upper drive shaft (8), longitudinally housed in an arm (6) of a sewing machine (2);

a vertical-movement kinematic mechanism (19) operatively interposed between the first eccentric (21) and the rocking arm (18) for transmitting a vertical reciprocating motion to the top feed dog (17);

a horizontal-movement kinematic mechanism (20) operatively interposed between the second eccentric (29) and the rocking arm (18) for transmitting a horizontal reciprocating motion to the top feed dog (17), further comprising:

a box-shaped housing structure (34) operatively receiving the vertical- and horizontal-movement kinematic mechanisms (19, 20);

detachable coupling means (35*a*, 35*b*, 36, 36*a*) for removably engaging the box-shaped housing structure (34) to the sewing machine (2);

an auxiliary shaft (37) rotatably received in the housing structure (34), carrying said first and second control eccentrics (21, 29) and provided at one end thereof with a first half-coupling (38) appearing externally of the box-shaped structure (34) through an access opening (39) formed on one side thereof;

an interconnecting stem (41) rotatably engaged to the sewing machine arm (6) and carrying, at one end thereof, a second half-coupling (40) to be operatively engaged with said first half-coupling (38)

when the housing structure (34) is connected to the sewing machine (2);

driving-gear means (45) operating between said upper drive shaft (8) and the interconnecting stem (41) for transmitting the rotatory motion from the upper drive shaft to the auxiliary shaft (37).

2. The detachable top feed unit as claimed in claim 1, wherein said driving-gear means (45) comprises a toothed belt (46) operatively engaged between a driving pulley (47) and a driven pulley (48) fitted to the upper drive shaft (8) of the sewing machine (2) and the interconnecting stem (41), respectively.

3. The detachable top feed unit as claimed in claim 1, wherein said interconnecting stem (41) and auxiliary shaft (37) extend consecutively according to an axis parallel to the upper drive shaft (8).

4. The detachable top feed unit as claimed in claim 1, wherein said first half-coupling (38) comprises a disk-shaped flange (38*a*) provided, in a misaligned position, with at least one pin (38*b*) adapted to engage in a mating seating (40*a*) arranged on the second half-coupling (40) for mutual connection between the auxiliary shaft (37) and the interconnecting stem (41) according to a predetermined angular positioning.

5. The detachable top feed unit as claimed in claim 1, wherein said detachable coupling mans comprises at least a first abutment surface (35*a*) and a second abutment surface (35*b*) formed on the sewing machine (2) and the housing structure (34) respectively, and adapted to be mutually engaged in abutment relationship, as well as threaded fastening elements (36) to be operatively engaged between the housing structure (34) and corresponding threaded holes (36*a*) formed in the sewing machine (2).

6. The detachable top feed unit as claimed in claim 1, wherein said interconnecting stem (41) is rotatably engaged in a casing (42) projecting from the rear part of the sewing machine arm (6).

* * * * *